US006948263B2

(12) United States Patent
Covatch

(10) Patent No.: US 6,948,263 B2
(45) Date of Patent: Sep. 27, 2005

(54) SHOE HAVING A MULTILAYERED INSOLE

(75) Inventor: Charles E. Covatch, Martinsburg, PA (US)

(73) Assignee: Columbia Insurance Company, Omaha, NE (US)

( * ) Notice: Subject to any disclaimer, the term of this patent is extended or adjusted under 35 U.S.C. 154(b) by 100 days.

(21) Appl. No.: 10/390,829

(22) Filed: Mar. 18, 2003

(65) Prior Publication Data

US 2004/0181970 A1 Sep. 23, 2004

(51) Int. Cl.[7] ..... A43B 21/32
(52) U.S. Cl. ..... 36/30 R; 36/35 R; 36/37; 36/44
(58) Field of Search ..... 36/30 R, 35 R, 36/37, 43, 44, 28, 33, 31

(56) References Cited

U.S. PATENT DOCUMENTS 4,316,335 A * 2/1982 Giese et al. ..... 36/129
4,918,838 A * 4/1990 Chang ..... 36/28
5,311,677 A * 5/1994 Mann et al. ..... 36/107
5,367,791 A * 11/1994 Gross et al. ..... 36/31
6,038,790 A * 3/2000 Pyle et al. ..... 36/30 R
6,519,874 B1 * 2/2003 Dean ..... 36/30 R

* cited by examiner

*Primary Examiner*—Jila M. Mohandesi
(74) *Attorney, Agent, or Firm*—St. Onge Steward Johnston & Reens LLC

(57) ABSTRACT

The invention relates to a method and apparatus for providing a shoe with a footbed, an insole having a first layer and a second layer, where the first layer includes a top surface, a bottom surface, and a hole extending from the top surface to the bottom surface. The second layer includes a top surface, a bottom location, and a hole extending from the top surface to the bottom location. Additionally, the shoe includes a protrusion extending from the footbed through the first layer to the bottom location of the second layer.

12 Claims, 7 Drawing Sheets

SHOE HAVING A MULTILAYERED INSOLE

FIELD OF THE INVENTION

The invention relates to a shoe having improved comfort.

BACKGROUND OF THE INVENTION

A variety of different sole constructions are used by the footwear industry. For the most part, each sole construction has characteristics that make it particularly well-suited for specific applications. For example, some constructions are selected for their durability, others for their comfort, while still others are selected for their aesthetic appeal.

Some of the shoes based on comfort typically have enhanced cushioning, which may result in a softer feel to a user's foot. Moreover, cushioning may be used or enhanced in any area of the shoe. Generally, the more cushioning, the softer the shoe feels to the user, resulting in improved comfort.

However, increasing the amount of cushioning, particularly along the entire length of the shoe, often leads to a decrease in breathability and increase in moisture being trapped within the cushioning. The lack of breathability and/or increase in moisture is believed to result in an environment favorable to fungi growth or odor, either of which undesirably counters the beneficial effects of having improved cushioning.

One manner of improving comfort while reducing the disadvantages is to enhance the cushioning in selected areas of the shoe, such as the heel or ball areas.

U.S. Pat. No. 6,474,003 ("Erickson") appears to relate to a shoe having a recess extending through the insole and an insole pad having a protrusion that protrudes downwardly into the recess. In addition, the insole pad appears to include an aperture for placing the protrusion.

U.S. Pat. No. 5,068,983 ("Marc") appears to relate to a shoe having a recess extending through the base piece and a heel piece made of cushioning material being placed within the recess. A top cushioning layer is placed over both the base and heel pieces.

U.S. Pat. No. 3,859,740 ("Kemp") appears to relate to a shoe having a recess extending through multiple layers and a cushion placed within the recess. It appears Kemp requires a part of the recess to be free from any object in order to provide clearance for bone spurs.

However, Erickson and Marc both seem to limit the cushioning to a depth of the insole or base piece, which often represents a fraction of the overall depth of the interior of the shoe. Kemp also seems to have a limited amount of cushioning due to the requirement of a part of the recess to free from being occupied by any object.

What is desired, therefore, is a shoe having improved comfort while reducing moisture content and/or improving breathability. Another desire is to enhance cushioning beyond the limited capabilities of the prior art.

SUMMARY OF THE INVENTION

Accordingly, it is an object of the invention to improve cushioning in selected areas of the shoe while reducing moisture and odor.

Another object of the invention is to maximize the cushioning in the selected areas of the shoe.

A further object is to extend a recess through multiple layers of the interior of the shoe and fill the cavity with a fitted cushion.

These and other objects of the invention are achieved by provision of a shoe having a footbed, an insole having a first layer and a second layer, where the first layer includes a top surface, a bottom surface, and a hole extending from the top surface to the bottom surface. The second layer includes a top surface, a bottom location, and a hole extending from the top surface to the bottom location. Additionally, the shoe includes a protrusion extending from the footbed through the first layer to the bottom location of the second layer.

In a further embodiment, the insole may include at least one middle layer placed between the first and second layers and having a top surface and a bottom surface and a hole extending from the top surface to the bottom surface of the at least one middle layer.

In another embodiment, the shoe includes a sole having a top surface, a bottom point, and a recess extending from the top surface to the bottom point. The protrusion may extend from the footbed through the first and second layers to the bottom point of the sole.

The hole has a periphery approximately a same size as a periphery of the protrusion. The protrusion is located in at least one localized area of the insole.

In another aspect of the invention, a method is provided for constructing the shoe in accordance with the invention includes the steps of providing a footbed and providing an insole having a first layer and a second layer, wherein the first layer has a top surface and a bottom surface and the second layer has a top surface and a bottom location. The method also includes extending a hole from a top surface to a bottom surface of the first layer, extending a hole from a top surface to a bottom location of the second layer, and extending a protrusion from the footbed through the first layer to the bottom location of the second layer.

In a further embodiment, the method may also include the step of placing at least one middle layer between the first and second layers and having a top surface and a bottom surface and extending a hole from the top surface to the bottom surface of the at least one middle layer.

In still a further embodiment, the method may also include providing a sole having a top surface and a bottom point and extending a recess from the top surface to the bottom point of the sole. The method may extend the protrusion from the footbed through the first and second layers to the bottom point of the sole.

The invention and its particular features and advantages will become more apparent from the following detailed description considered with reference to the accompanying drawings.

DETAILED DESCRIPTION OF THE DRAWINGS

Figure 1:
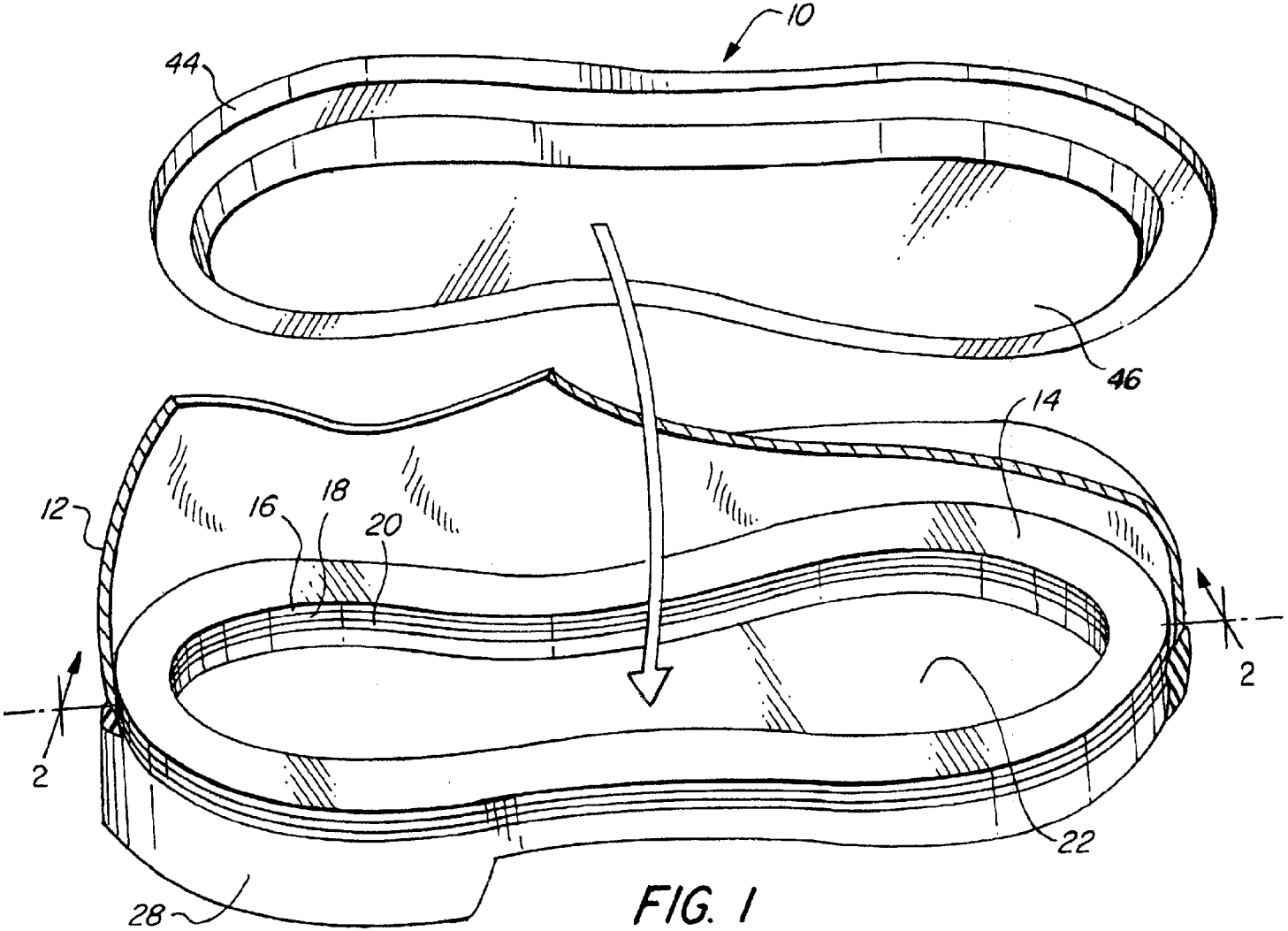
FIG. 1 depicts the shoe in accordance with the invention.

FIG. 1 depicts the shoe 10 in accordance with the invention. Shoe 10 includes upper 12, insole 14, sole 28, and footbed 44. Insole 14 includes at least first and second layers, 16 and 20. As shown, insole also includes middle layer 18. In other embodiments, insole 14 comprises multiple layers. First, middle, and second layers are more particularly depicted in FIG. 2. All that is required is for insole 14 to be of at least two layers.

Shoe 10 also includes footbed 44 and protrusion 46 extending downwardly from footbed 44. Protrusion is made of a soft material for enhancing comfort to a user's foot. Footbed 44 may, but need not, be of the same material as protrusion 46. In some embodiments, protrusion is integrally formed with footbed 44, thereby defining a single unit. In other embodiments, protrusion 46 is secured to footbed 44 by any known or novel manners for attaching protrusion 46 and footbed 44 together. All that is required is for protrusion 46 to extend downwardly from footbed 44.

As shown, insole 14 also has hole 22, which defines a cavity for receiving protrusion 46. A periphery of protrusion 46 is generally similar in size and shape as a periphery of hole 22. Because protrusion 46 is of a soft material, its periphery may be larger than the periphery of hole 22 and still be able to squeeze into hole 22. In fact, this may be preferred because protrusion 46 will be held more securely in hole 22 than if hole 22 was too large. Similarly, because protrusion 46 is of a soft material, its periphery may be slightly different than hole 22. Also, the depth of protrusion 46 need only be similar to a depth of hole 22. Similar to the above reasons, the depth of protrusion 46 may even be deeper than the depth of hole 22 so that protrusion 46 is adequately secured in hole 22. Because the periphery and size of protrusion 46 and hole 44 need not be exact and may further be different to a certain degree, this reduces manufacturing costs since tolerances need not be critical.

Protrusion 46 provides additional cushioning for the user's foot beyond the cushioning provided by footbed 44 and/or insole 14. This is accomplished by hole 22, which allows protrusion 46 to be placed in shoe 10 without increasing the overall thickness of insole 14 or, in general, shoe 10.

Figure 6:
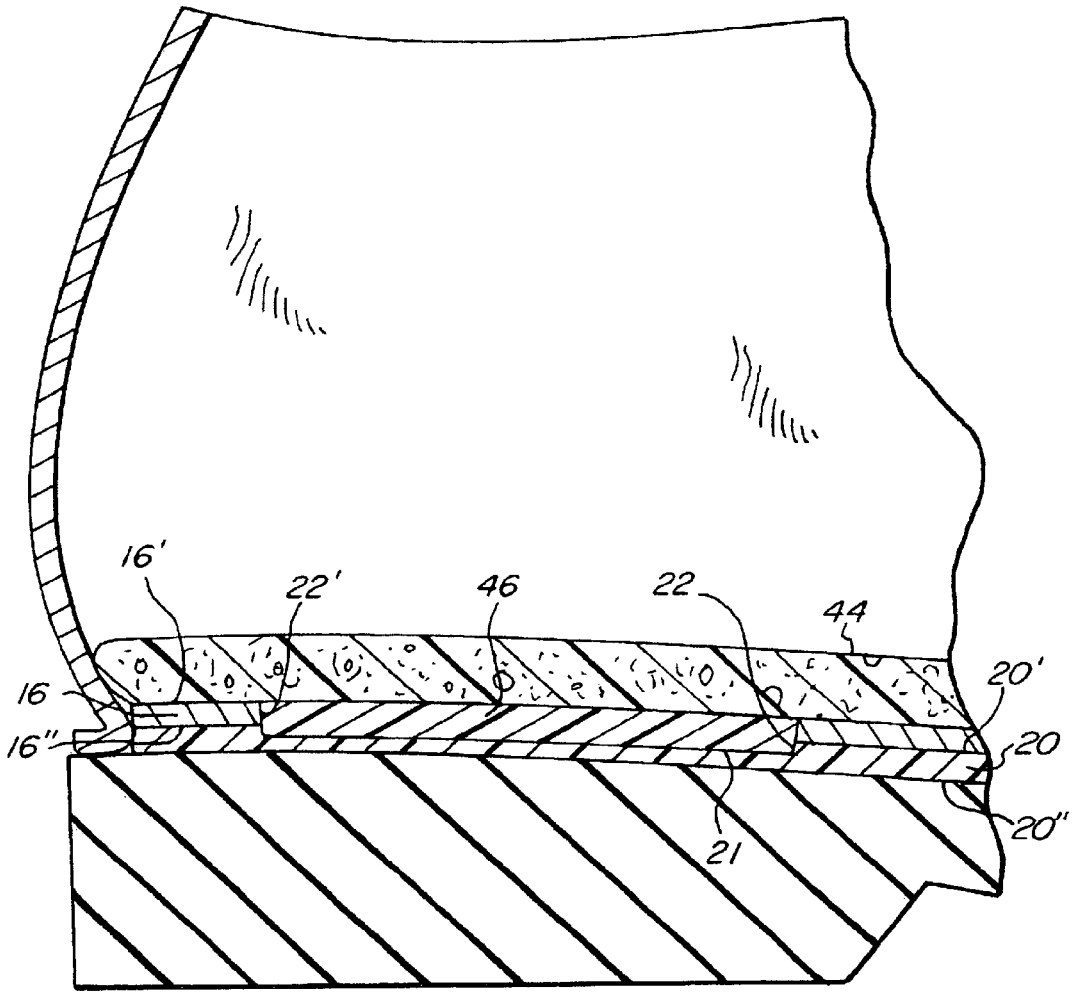
FIG. 6 depicts another embodiment of the shoe shown in FIG. 1.

Hole 22 refers to the holes passing through first, middle, and second layers, 16, 18, and 20, of insole 14. As described above, and in the embodiment shown in FIGS. 1 and 2, insole 14 may be made of numerous layers, in which case hole 22 may pass through all of them. Hole 22 need not pass through all layers of insole 14 but need only pass through at least one layer and into at least a second layer so that protrusion 46 may be adequately secured in hole 22, as shown in FIG. 6. Moreover, hole 22 and protrusion 46 both need only extend through at least one layer and into at least a second layer to provide adequate cushioning for the user's foot.

As shown in FIG. 6, hole 22' in first layer 16 extends from a top surface 16' of first layer 16 to a bottom surface 16" of first layer 16. Hole 22" in second layer 20 extends from a top surface 20' of second layer 20 to a bottom location 21 of second layer 20, where bottom location 21 need not be the bottom surface 20" of second layer 20. Insole 14 of FIG. 6 does not have a middle layer and holes 22' and 22", which define hole 22, represent a minimum depth of hole 22. Protrusion 46 extends from footbed 44 through first layer 16 to bottom location 21 of second layer 20.

Figure 2:
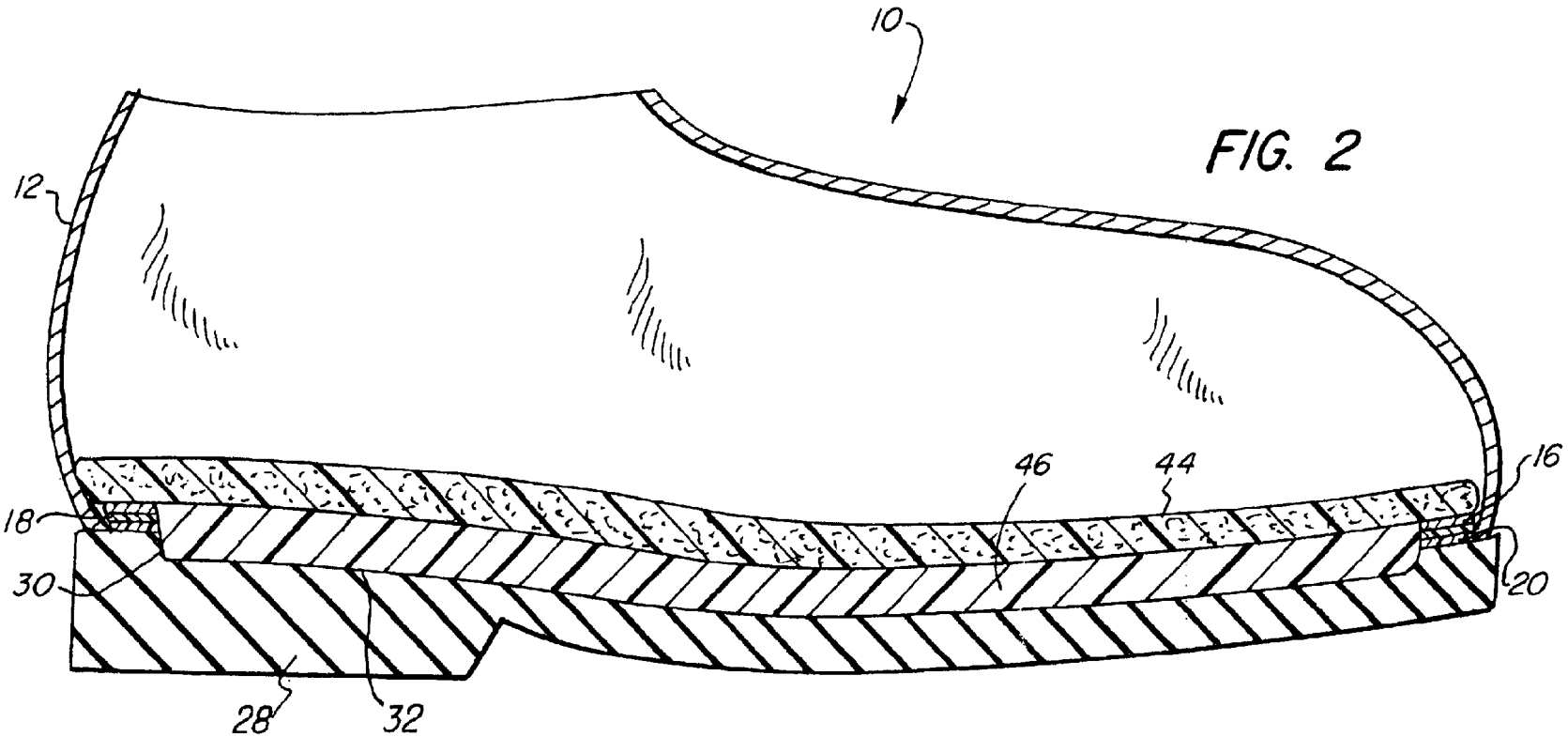
FIG. 2 depicts a cross sectional view of the shoe shown in FIG. 1.

As shown in FIG. 2, hole 22 passes through first layer 16, middle layer 18, and second layer 20. In this embodiment, bottom location 21 is at bottom surface 20" of second layer 20. Protrusion 46 likewise passes through first layer 16, middle layer 18, and second layer 20 and extends to bottom point 32 of recess 30 in sole 28. As shown, recess 30 penetrates sole 28 but does not go completely through sole 28. Recess 30 is not needed for the invention to function properly but provides further depth, in addition to hole 22, for protrusion 46 and, therefore, improves the cushioning to the user's foot beyond the capabilities of the embodiment shown in FIG. 6.

Figure 3:
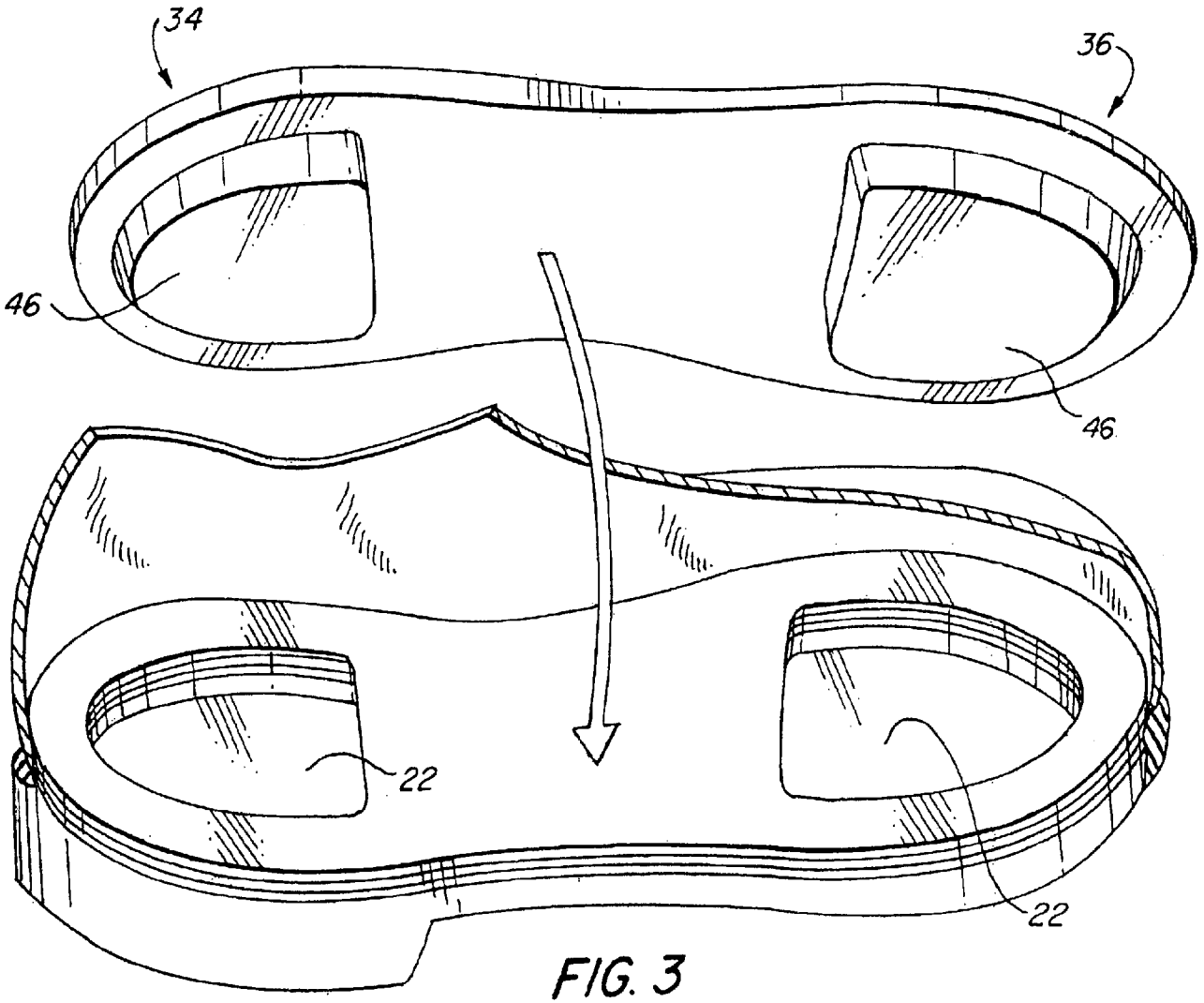
FIG. 3 depicts another embodiment of the shoe shown in FIG. 1.
Figure 4:
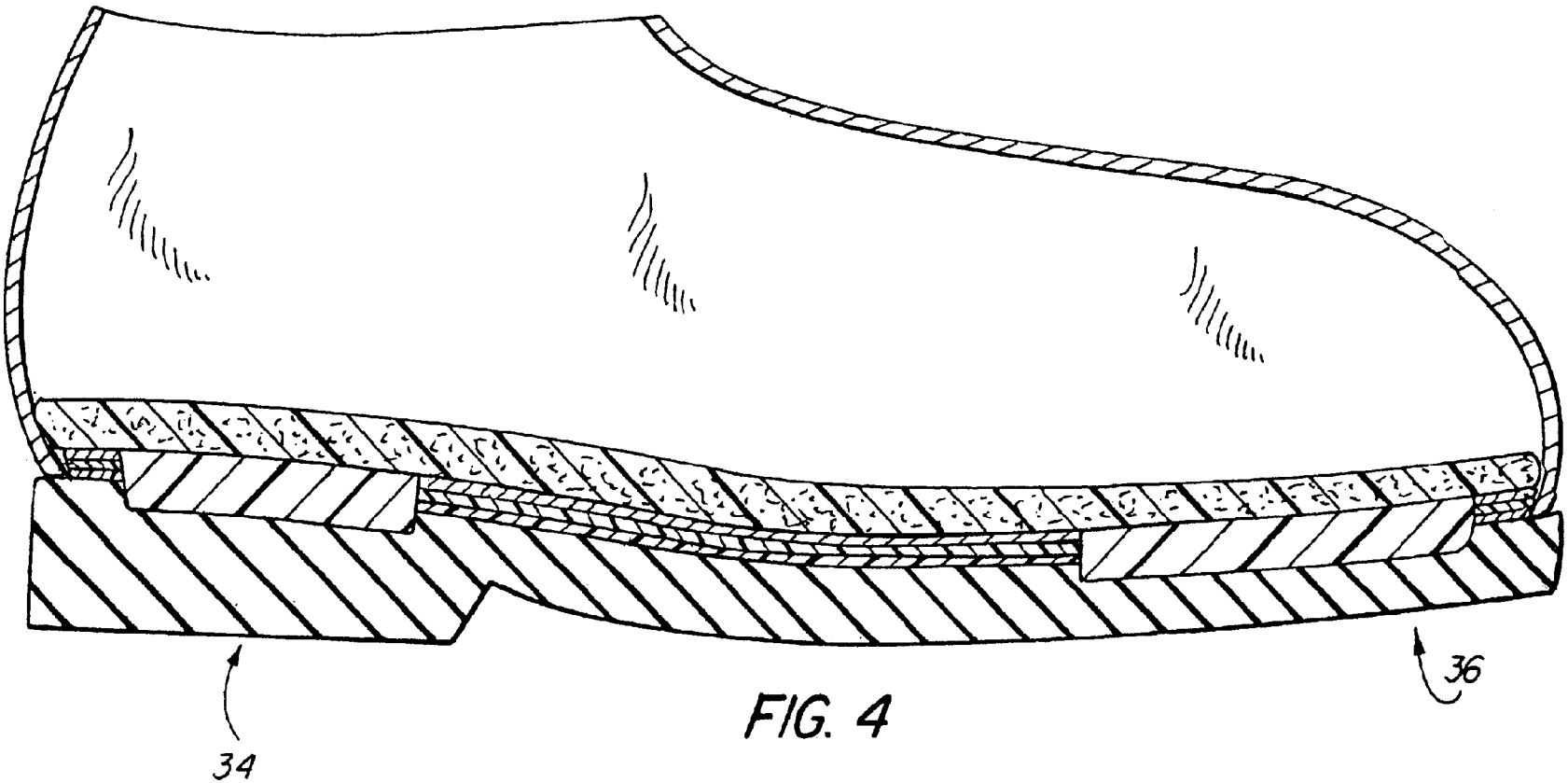
FIG. 4 depicts a cross sectional view of the shoe shown in FIG. 3.

In another embodiment, shown in FIGS. 3 and 4, hole 22 and protrusion 46 are positioned in localized areas of shoe 10. Positioning hole 22 and protrusion 46 in, for example, heel area 34 and toe area 36 reduces moisture and odor due to the overall reduced amount of cushioning, yet shoe 10 still provides adequate cushioning in the areas believed to be needing it most for user comfort.

Figure 5:
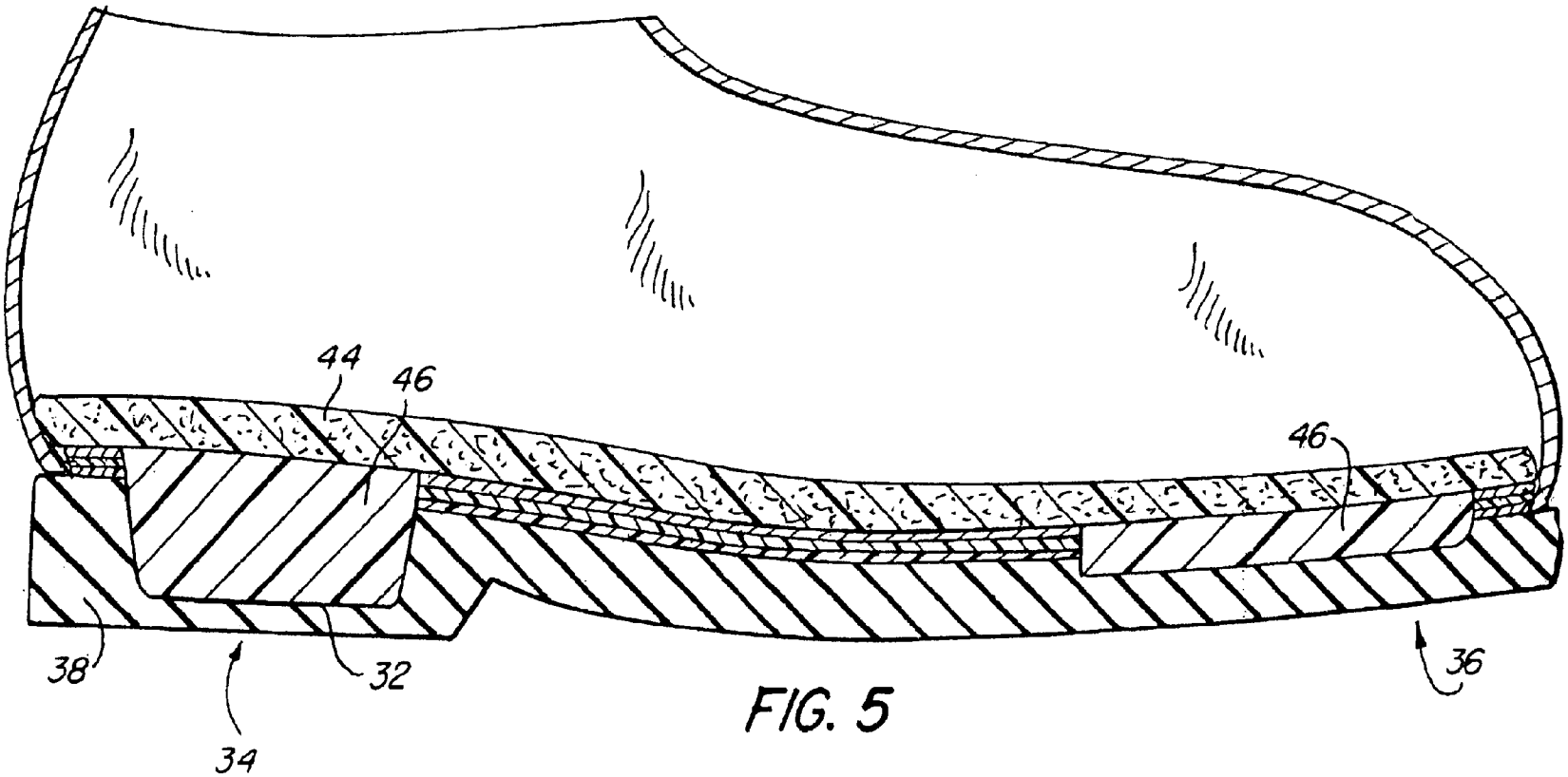
FIG. 5 depicts another embodiment of the shoe shown in FIG. 1.

FIG. 5 depicts another embodiment of shoe 10 having maximum cushioning in heel area 34 by extending hole 22 through first, middle, and second layers, 16, 18, and 20 to bottom point 32 of recess 30, where bottom point 32 is as low in heel 38 as possible without sacrificing structural integrity. This embodiment takes advantage of the space in heel 38 and uses it to maximize a depth of hole 22 and protrusion 46 in heel area 34.

In another embodiment, not shown, hole 22 and protrusion 46 extend continuously from heel area 34 to toe area 36, similar to the embodiment of FIGS. 1 and 2, but has a depth that varies in selected areas of shoe 10, such as heel area 34 and toe area 36. In this embodiment, hole 22 and protrusion 46 extend further into insole 14 and/or sole 28 than in other areas of shoe 10, such as an arch area.

Figure 7:
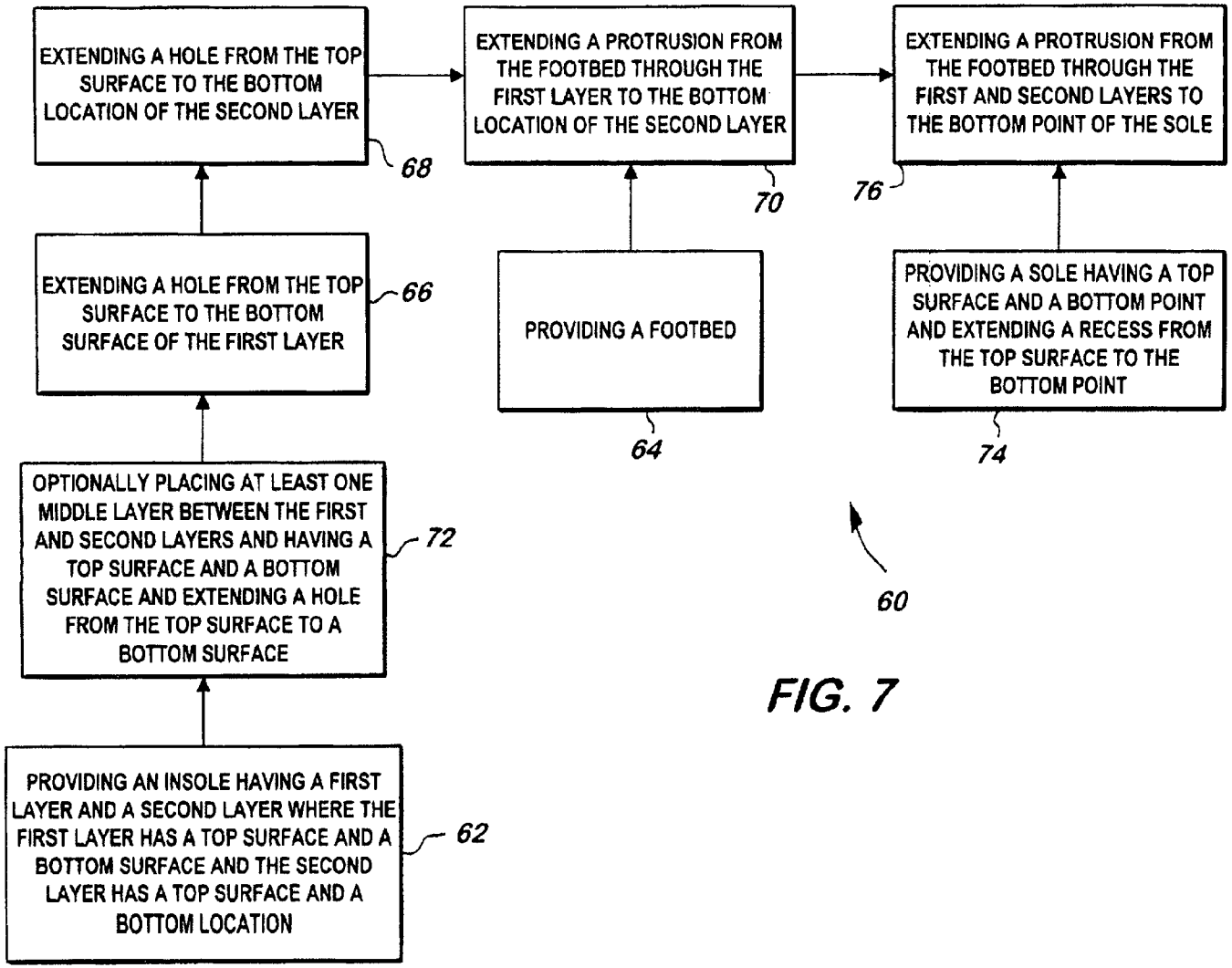
FIG. 7 depicts a method for providing the shoe shown in FIGS. 1–6.

FIG. 7 depicts a method for providing the shoe in accordance with the invention. Method 60 includes the steps of providing 62 an insole having a first layer and a second layer, where the first layer has a top surface and a bottom surface and the second layer has a top surface and a bottom location. Method 60 also extends 66 a hole from the top surface to the bottom surface of the first layer and extends 68 a hole from the top surface to the bottom location of the second layer, where the bottom location may, but need not, be at the bottom surface of the second layer. Method 60 further provides 64 a footbed and extends 70 a protrusion from the footbed through the first layer to the bottom location of the second layer.

In this fashion, method 60 may provide the shoe depicted in FIG. 6, where the bottom location is located between the top and bottom surfaces of the second layer. On the other hand, method 60 may also provide the shoe depicted in FIGS. 1 and 2, where the bottom location is located at the bottom surface of the second layer.

Optionally, and as shown in FIGS. 1, 2, and 7, method 60 places 72 at least one middle layer between the first and second layers and having a top surface and a bottom surface and extending a hole from the top surface to the bottom surface of the at least one middle layer.

Optionally, and as shown in FIGS. 1, 2, and 7, method 60 provides 74 a sole having a top surface and a bottom point and extending a recess from the top surface to the bottom point. In this embodiment, method 60 extends 76 the protrusion from the footbed through the first and second layers, and optional middle layer(s), to the bottom point of the sole.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A shoe, comprising:

a footbed;

an insole having a first layer and a second layer;

said first layer having a top surface, a bottom surface, and a hole extending from said top surface to said bottom surface;

said second layer having a top surface, a bottom location, and a hole extending from said top surface to said bottom location;

a protrusion extending from said footbed through said first layer to said bottom location of said second layer; and said protrusion is integrally connected to said footbed so that said protrusion and said footbed define a single unit.

2. The shoe in accordance with claim 1, wherein said insole further comprises at least one middle layer placed between said first and second layers and having a top surface and a bottom surface and a hole extending from said top surface to said bottom surface of said at least one middle layer.

3. The shoe in accordance with claim 1, further comprising a sole having a top surface, a bottom point, and a recess extending from said top surface to said bottom point.

4. The shoe in accordance with claim 3, wherein said protrusion extends from said footbed through said first and second layers to said bottom point of said sole.

5. The shoe according to claim 1, wherein said hole in said first layer has a periphery approximately a same size as a periphery of said protrusion.

6. The shoe in accordance with claim 1, wherein said protrusion is located in at least one localized area of said insole.

7. The shoe in accordance to claim 1, wherein said insole is permanently connected to the shoe.

8. A method for providing a shoe, comprising the steps of:

providing a footbed;

providing an insole having a first layer and a second layer, wherein the first layer has a top surface and a bottom surface and the second layer has a top surface and a bottom location;

extending a hole from the top surface to the bottom surface of the first layer;

extending a hole from the top surface to the bottom location of the second layer;

extending a protrusion from the footbed through the first layer to the bottom location of the second layer; and integrally connecting the protrusion to the footbed so that the protrusion and the footbed define a single unit.

9. The method in accordance with claim 8, further comprising the step of placing at least one middle layer between the first and second layers and having a top surface and a bottom surface and extending a hole from the top surface to the bottom surface of the at least one middle layer.

10. The method in accordance with claim 8, further comprising the step of providing a sole having a top surface and a bottom point and extending a recess from the top surface to the bottom point of the sole.

11. The method in accordance with claim 8, further comprising the step of extending the protrusion from the footbed through the first and second layers to the bottom point of the sole.

12. The method according to claim 8, further comprising the step of permanently connecting the insole to the shoe.

* * * * *